US006077394A

United States Patent [19]

Spence et al.

[11] Patent Number: 6,077,394

[45] Date of Patent: Jun. 20, 2000

[54] RETENTION AND DRAINAGE IN ALKALINE FINE PAPER

[75] Inventors: Gavin G. Spence, Columbus, Ga.; Duane R. Palmateer, Middle Grove, N.Y.; James R. Yarnell, Columbus, Ga.

[73] Assignee: Callaway Chemical Corporation, Columbus, Ga.

[21] Appl. No.: 09/281,368

[22] Filed: Mar. 30, 1999

Related U.S. Application Data

[60] Provisional application No. 60/080,123, Mar. 31, 1998.

[51] Int. Cl.[7] ..... D21H 17/55; D21H 17/45; D21H 17/52; D21H 17/66

[52] U.S. Cl. ..... 162/164.3; 162/164.6; 162/168.2; 162/168.3; 162/181.2; 162/181.4

[58] Field of Search ..... 162/158, 164.1, 162/164.3, 164.6, 183, 168.2, 168.3, 181.1, 181.2, 181.4, 181.5, 166

[56] References Cited

U.S. PATENT DOCUMENTS

| | | | |
|---|---|---|---|
| 3,311,594 | 3/1967 | Earle | 525/430 |
| 3,442,754 | 5/1969 | Epsy | 162/164.6 |
| 3,556,932 | 1/1971 | Coscia et al. | 162/166 |
| 4,605,702 | 8/1986 | Guerro et al. | 525/154 |
| 5,527,430 | 6/1996 | Gill | 162/158 |
| 5,595,629 | 1/1997 | Begala | 162/158 |
| 5,674,632 | 10/1997 | Ahern et al. | 428/612 |
| 5,695,609 | 12/1997 | Petander et al. | 162/164.6 |
| 5,725,731 | 3/1998 | Brungardt et al. | 162/72 |
| 5,783,041 | 7/1998 | Underwood | 162/164.1 |

OTHER PUBLICATIONS

Au et al., "Applications of Wet–End Paper Chemistry," First edition 1995, pp. 111–113.

*Primary Examiner*—Stanley S. Silverman
*Assistant Examiner*—José A. Fortuna
*Attorney, Agent, or Firm*—Bruce F. Jacobs

[57] ABSTRACT

A method for making alkaline fine paper which comprises adding (i) a glyoxylated acrylamide-diallyldimethyl ammonium chloride resin and (ii) an aminopolyamide-epichlorohydrin resin to an alkaline fine paper pulp slurry containing filler material during a papermaking process, the resins being added in an amount and at a rate sufficient to increase the retention of the filler in the paper and drainage of process water from the slurry.

16 Claims, 4 Drawing Sheets

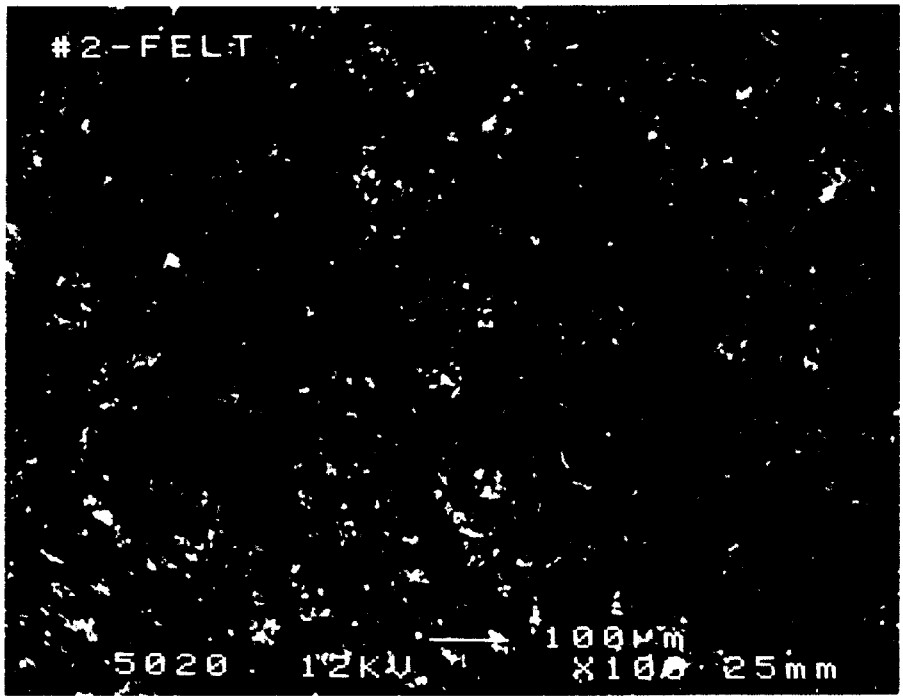
FIGURE 4A (Prior Art)
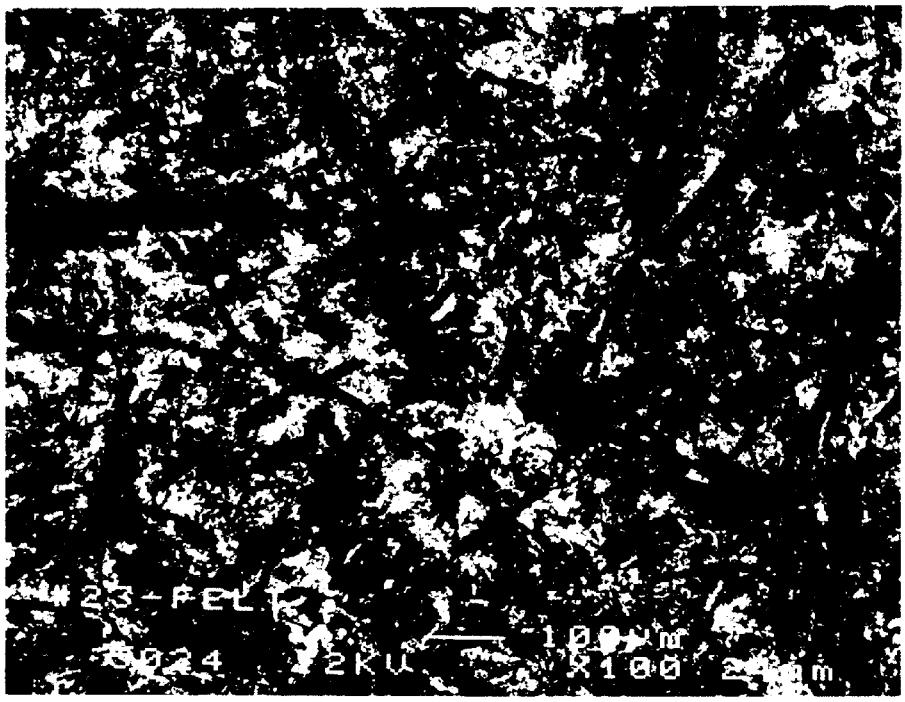
FIGURE 4B (Invention)

RETENTION AND DRAINAGE IN ALKALINE FINE PAPER

CROSS-REFERENCE TO RELATED APPLICATION

This application claims the benefit of U.S. Provisional Application No. 60/080,123 filed Mar. 31, 1998.

FIELD OF THE INVENTION

The present invention is directed to the field of making alkaline fine paper, and to improving the retention of fillers and the drainage of process water during the process.

BACKGROUND OF THE INVENTION

The formation of certain papers involves the retention of fine particles including fiber fines and inorganic fillers in the pulp slurry during the papermaking process such that the fillers impart desired properties to the resulting paper. During the production of fine alkaline papers, for instance, calcium carbonate is used as a filler to impart desired optical properties such as brightness and opacity. In addition, since calcium carbonate is significantly less expensive than pulp fibers, use of calcium carbonate as a filler reduces the cost of producing paper. To improve fine particles retention in the paper retention aids are commonly used. Retention aids are usually high molecular weight acrylamide copolymers in which the comonomer can be anionic, cationic or nonionic. These water soluble retention aids are essentially flocculants by nature.

The formation of paper from a pulp slurry also involves the drainage of process water on a continuously moving wire screen, dewatering by pressing wet webs between wet felts and drying on a series of heated drums. The rate of paper production depends on how efficiently the water is removed from the web during this process without adversely affecting the formation or physical properties of the sheet. Drainage aids are often used to increase the rate of dewatering. Drainage aids are usually low molecular weight water soluble polymers or resins that have a high cationic charge density. It is common practice to use both a drainage aid and a retention aid during the production of paper such as alkaline fine paper.

It has been found unexpectedly that the retention of fillers in the sheet can be increased during the papermaking process by adding to a filler-containing alkaline fine paper slurry resins known to provide wet and/or dry strength to unfilled paper. Specifically, an aminopolyamide-epichlorohydrin (APAE) resin and a glyoxylated acrylamide-diallyldimethylammonium chloride (GPA) resin, preferably in the form of a mixed resin solution, are added to the slurry during the papermaking process. The resins are added in an amount and at a rate sufficient to increase the retention of the filler in the paper and the drainage of the process water from the slurry. By so doing, the speed of operation of a papermaking machine can be substantially increased.

U.S. Pat. No. 5,674,362 discloses the use of the same resins in a recycle pulp slurry to provide both wet and dry strength. The slurries used in this invention differ from recycle pulp slurries due to the presence of the filler material. Furthermore, the slurries differ because alkaline fine paper is made using bleached pulp, usually predominantly virgin pulp with little or no recycle pulp. Also, the papers produced hereby have been found to exhibit no significant increase in dry strength as compared to paper produced in the absence of the two resins.

It is an object of this invention to develop a method for improving retention of fillers in the pulp slurry and drainage of process water from the slurry during a papermaking process.

It is a further object to increase the speed of an alkaline fine paper papermaking machine.

These and still further objects will be apparent from the following detailed disclosure of the present invention.

SUMMARY OF THE INVENTION

The invention is directed to a method for making paper which includes adding (i) a glyoxylated acrylamide-diallyldimethyl ammonium chloride resin and (ii) an aminopolyamide-epichlorohydrin resin to an alkaline fine paper pulp slurry which contains at least 5% filler during a papermaking process, the resins being added in an amount and at a rate that is sufficient to increase the retention of fillers in the paper and increase the drainage of process water from the slurry. The method enhances the retention performance of other filler retention systems. The method enhances the rate at which process water is removed from the slurry and, as such, the method increases the paper machine speed.

DESCRIPTION OF THE DRAWINGS

FIGS. 4*a* and 4*b* are 100× magnification drawings of photomicrographs of the top surface of papers (a) Prior Art and (b) Invention.

DESCRIPTION OF THE PREFERRED EMBODIMENTS

Figure 1:
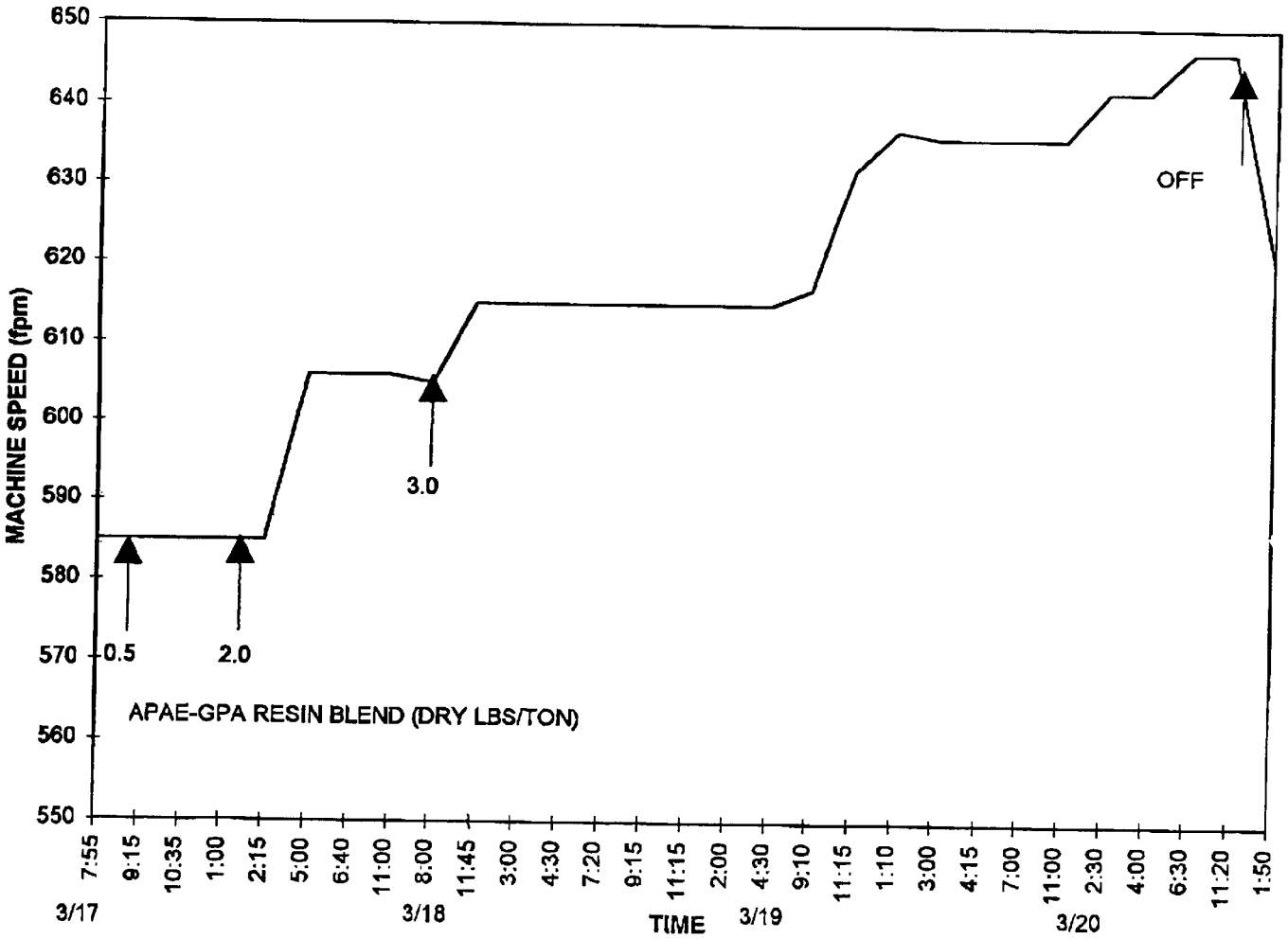
FIG. 1 is a graph showing the method of the invention increasing the speed of a paper machine.

The step of adding a glyoxylated acrylamide-diallyldimethyl ammonium chloride (GPA) resin and an aminopolyamide-epichlorohydrin (APAE) resin generally involves adding a mixed resin solution containing GPA and APAE resins in sufficient amounts and rates that the retention of fillers in an alkaline fine paper increases during the papermaking process. The addition of the two resins also increases the rate at which water is drained from the slurry. Fine alkaline papers are those papers such as book paper, writing paper, and photocopy paper. The pulp slurry can contain bleached hardwood sulfite pulp, bleached softwood sulfite pulp, bleached hardwood Kraft pulp, bleached softwood Kraft pulp and blends thereof.

The slurry further contains fillers such as calcium carbonate, clay, titanium dioxide, talc, or a combination of such fillers. The amount of the fillers is generally at least 5%, preferably from about 7 to about 30 wt %, based on the dry weight of the pulp slurry. The pH of the slurry is generally from about 6 to about 9.

The slurry further preferably contains one or more retention agents ordinarily used in papermaking processes. Suitable organic retention agents can include high molecular weight anionic polyacrylamide copolymers; high molecular weight cationic polyacrylamide copolymers, and the like. Other retention systems include so called microparticle retention systems that utilize small particle additives such as colloidal silica.

The pulp slurry further generally contains dewatering agents ordinarily used in papermaking processes. Suitable such dewatering agents include polyamine-epichlorohydrin resin, poly(ethyleneimine), poly(diallyldimethyl ammonium chloride), and poly(aluminum chloride).

The pulp slurry further contains GPA and APAE resins. The GPA resin can be any resin having a glyoxylated functionality such that the resin is capable of being used in accordance with the invention. Suitable GPA resins are known for use as dry strength and temporary wet strength resins for paper and include those disclosed in U.S. Pat. No. 4,605,702. The GPA resin are typically supplied in the form of relatively dilute aqueous solutions containing only about 5–10 wt % resin.

The GPA resin is prepared by first copolymerizing an acrylamide monomer with diallyldimethyl ammonium chloride (DADMAC) in aqueous solution, and then reacting the resulting copolymer with glyoxal, such as is disclosed in U.S. Pat. Nos. 3,556,932, and 4,605,702. Although not presently preferred, other copolymers may be used: methacryloyloxyethyl trimethyl ammonium methyl sulfate, methacryloyloxyethyl trimethyl ammonium chloride, acryloyloxyethyl trimethyl ammonium methyl sulfate, acryloyloxyethyl trimethyl ammonium chloride, acrylamidopropyl trimethyl ammonium chloride. The subject matter of each patent is incorporated herein by reference. A resin solution of GPA generally has a viscosity of less than about 150 cp and does not gel for at least 14 days when kept at room temperature as a solution containing 8 wt % resin.

Suitable acrylamide monomers for use herein may be any acrylamide, such as acrylamide per se, methacrylamide and the like. Moreover, up to about 10% by weight of the acrylamide comonomers may be replaced by other comonomers copolymerizable with the acrylamide, i.e. acrylic acid, acrylic esters such as ethyl acrylate, methylmethacrylate, acrylonitrile, styrene, vinylbenzene sulfonic acid, and the like. Generally, from about 75 to about 95 wt % acrylamide, and from about 5 to 25 wt % diallyldimethyl ammonium chloride are used. In copolymerizing the acrylamide with the diallyldimethyl ammonium chloride, free radical generating initiators are generally added to an aqueous monomer solution. The polymerization takes place at a temperature that is generally between about room temperature and about 100° C. The resulting AM-DADMAC copolymer has an equivalent molecular weight that is generally in the range from about 500 to 100,000 daltons, preferably about 35,000 to about 50,000 daltons. In reacting the resulting acrylamide-DADMAC copolymer and the glyoxal, the mole ratio of the glyoxal to the acrylamide copolymer is preferably between about 2:1 to about 0.5:1, and more preferably about 1:1. The temperatures employed are preferably from about 25° C. to about 100° C., and the pH during the reaction is preferably kept within the range of about 3 to about 10. Suitable GPA resins may be obtained from Callaway Chemical Company, Columbus, Ga. under the trade name Discostrength® 19.

The aminopolyamide-epichlorohydrin (APAE) resin can be any resin having aminopolyamide-epichlorohydrin functionality such that the resin is capable of being used in accordance with the invention. APAE resins have been used as wet strength additives for paper. U.S. Pat. No. 3,311,594, discloses the preparation of APAE wet strength resins. The resins are prepared by reacting epichlorohydrin with aminopolyamides, sometimes referred to as polyaminoamides, or polyaminourylenes containing secondary amino hydrogens.

The APAE resin is prepared by reacting an aminopolyamide and epichlorohydrin such as is disclosed in U.S. Pat. Nos. 3,197,427, 3,442,754, and 3,311,594, the subject matter of each patent is incorporated herein by reference. APAE resin solutions have a viscosity of less than about 150 cp for at least 90 days when kept at room temperature as a solution containing about 12.5 wt % resin.

The aminopolyamide is formed by reacting a carboxylic acid with a polyalkylene polyamine under conditions which produce a water-soluble, long-chain polyamide containing the recurring groups:

$$—NH(C_nH_{2n}HN)_x—CORCO—$$

wherein n and x are each 2 or more and R is the divalent, organic radical of the dicarboxylic acid. Dicarboxylic acids useful in preparing the aminopolyamide include saturated aliphatic dicarboxylic acids, preferably containing from about 3 to 8 carbon atoms, such as malonic, succinic, glutaric, adipic, and so on, together with diglycolic acid. Of these, diglycolic acid and the saturated aliphatic dicarboxylic acids having from about 4 to 6 carbon atoms in the molecule, namely, succinic, glutaric, and adipic acids are the most preferred. Blends of two or more dicarboxylic acids may be used, as well as blends which include higher saturated aliphatic dicarboxylic acids such as azelaic and sebatic, as long as the resulting long-chain polyamide is water soluble or at least water dispersible.

Useful polyamines include polyalkylene polyamines such as polyethylene polyamines, polypropylene polyamines, polyoxybutylene polyamines. More specifically, the polyalkylene polyamines of this invention are polyamines containing two primary amine groups and at least one secondary amine group in which the nitrogen atoms are linked together by groups of the formula $—C_nH_{2n}—$ where n is a small integer greater than about 1, and the number of such groups in the molecule ranges from up to about eight, preferably about four. The nitrogen atoms may be attached to adjacent carbon atoms in the $—C_nH_{2n}—$ group or to carbon atoms further apart, but not to the same carbon atom. Specific polyamines include but are not limited to diethylenetriamine, triethylenetetramine, tetraethylenepentamine, dipropylenetriamine, and the like. Suitable polyamines for use in this invention also include mixtures and various crude polyamine materials, such as the polyamine mixture obtained by reacting ammonia and ethylene dichloride. A preferred method for preparing the APAE resin entails reacting an aminopolyamide with epichlorohydrin in a mole ratio of epichlorohydrin to free amino groups of about 0.5:1.8, and more preferably 0.5:1.5 in aqueous solution, and more preferably 1:1.25. The temperature may vary from about 45° C. to about 100° C. Suitable APAE resins are commercially available and may be obtained from several sources including Callaway Chemical Company, Columbus, Ga. under the trade name Discostrength® 5800.

The GPA:APAE weight ratio is such that the resins can effectively increase retention of fillers in the paper and increase drainage of process water from the slurry. Suitable weight ratios can be determined by one skilled in the art with routine experimentation. GPA:APAE weight ratios that have been suitable are generally from about 3:1 to about 1:3, and preferably from about 1:1.

Generally the GPA and APAE are added to the pulp slurry in the form of a solution. Preferably, solutions of the two resins are pre-mixed prior to addition to the pulp slurry. Such a mixed resin solution can be made by any method which produces a suitable mixed solution. Preferably, the solution is made before it is added to the pulp slurry. As such, a method of this invention preferably includes using a premixed GPA:APAE resin solution. Preferably, the solution is mixed until a substantially homogenous final resin solution is produced. The mixing time is generally from about 5 minutes to about 1 hour, but factors such as the GPA:APAE weight ratio, the mixing temperature, and the mixing technique utilized may influence the actual mixing time.

The preferred mixed resin solution is added to the pulp slurry at a dosage rate that will impart the desired increase in the retention of fillers in the paper and the drainage of process water from the slurry. Generally, the resin solution is applied at a dosage rate that is at least about 1 pound per ton dry pulp, preferably from about 1 to about 10 pounds per ton, and even more preferably from about 1 to about 3 pounds per ton. The actual dosage rate, however, may vary according to factors such as the resin concentration of the mixed resin solution, the temperature, and the equipment used.

The addition of the resins has substantially enhanced the retention performance of existing retention systems, and thus, can reduce the amount of retention systems that needs to be used. The addition of the resins has substantially enhanced the rate process water is removed from the slurry and, as such, increase the paper machine speed. The addition of the mixed resin solution in accordance to the invention increases the retention performance of the slurry by at least 2%, preferably at least 5%, more preferably from about 2 to about 25%, and even more preferably from about 5 to about 10%. The addition of the mixed resin solution to the pulp slurry increases the dewatering performance of the slurry such that increases in the machine speed by at least about 2%, preferably from about 5 to about 25% can be achieved.

The following examples are set forth for the purposes of illustration only and are not to be construed as limitations on the present invention. All parts and percents are by weight unless otherwise specified.

EXAMPLE 1

A trial was run on a small (12 inch) pilot paper machine. The alkaline fine paper pulp furnish was a blend of bleached hardwood sulfite pulp and bleached softwood Kraft pulp. Calcium carbonate was added at a level of 23%. During the trial, several retention-drainage aid systems, including poly (aluminum chloride) followed by a high molecular weight anionic polyacrylamide copolymer were evaluated. During these trials the first pass retention ranged from 89–94%, and the wet line on the wire was approximately 15" from the back of the headbox. A 1:1 blend of GPA:APAE resins was then added at a level of 2–6 dry pounds per ton to the stock with the conventional retention aid system of 6 pounds per ton poly(aluminum chloride) followed by 0.6 pounds per ton anionic polyacrylamide. First pass retention increased to 92–97% and the wet line on the wire moved back to 8–10 inches from the back of the headbox.

EXAMPLE 2

A three day trial was run on a commercial paper machine. The grade of alkaline fine paper being produced was 41 pound book paper. The furnish consisted of approximately 60% bleached hardwood sulfite pulp, 15% bleached softwood Kraft pulp and 25% broke. Precipitated calcium carbonate was added as the filler at a level of approximately 10%. The conventional retention/drainage aid system consisted of 4.5 pounds per ton polyamine-epichlorohydrin resin followed by 0.5 pounds per ton high molecular weight anionic polyacrylamide.

A 1:1 blend of GPA:APAE resins in the form of a premixed solution was added at the wet end of the paper machine at an initial level of 0.5 dry pounds per ton. The dosage level of the blend was increased gradually until the level reached 3 dry pounds per ton after approximately 14 hours. This dosage level was maintained for the rest of the trial. The dosages of the conventional retention aid components were reduced gradually until after 15 hours the polyamine-epichlorohydrin resin was removed completely and the dosage of the high molecular weight anionic polyacrylamide was reduced to 0.18 pounds per ton.

During the trial several improvements in the process were observed.

First, due to improved drainage and drying, it was possible to increase machine speed significantly. As shown in FIG. 1, machine speed was increased from 585 feet per minute to 647 feet per minute. The production rate on the machine was thus increased significantly. When the GPA:APAE resins were removed at the end of the trial and the amounts of the resins of the standard retention system were brought back to normal, machine speed had to be dropped immediately to 621 feet per minute. After equilibration, the machine speed returned to 585 feet per minute.

Figure 2:
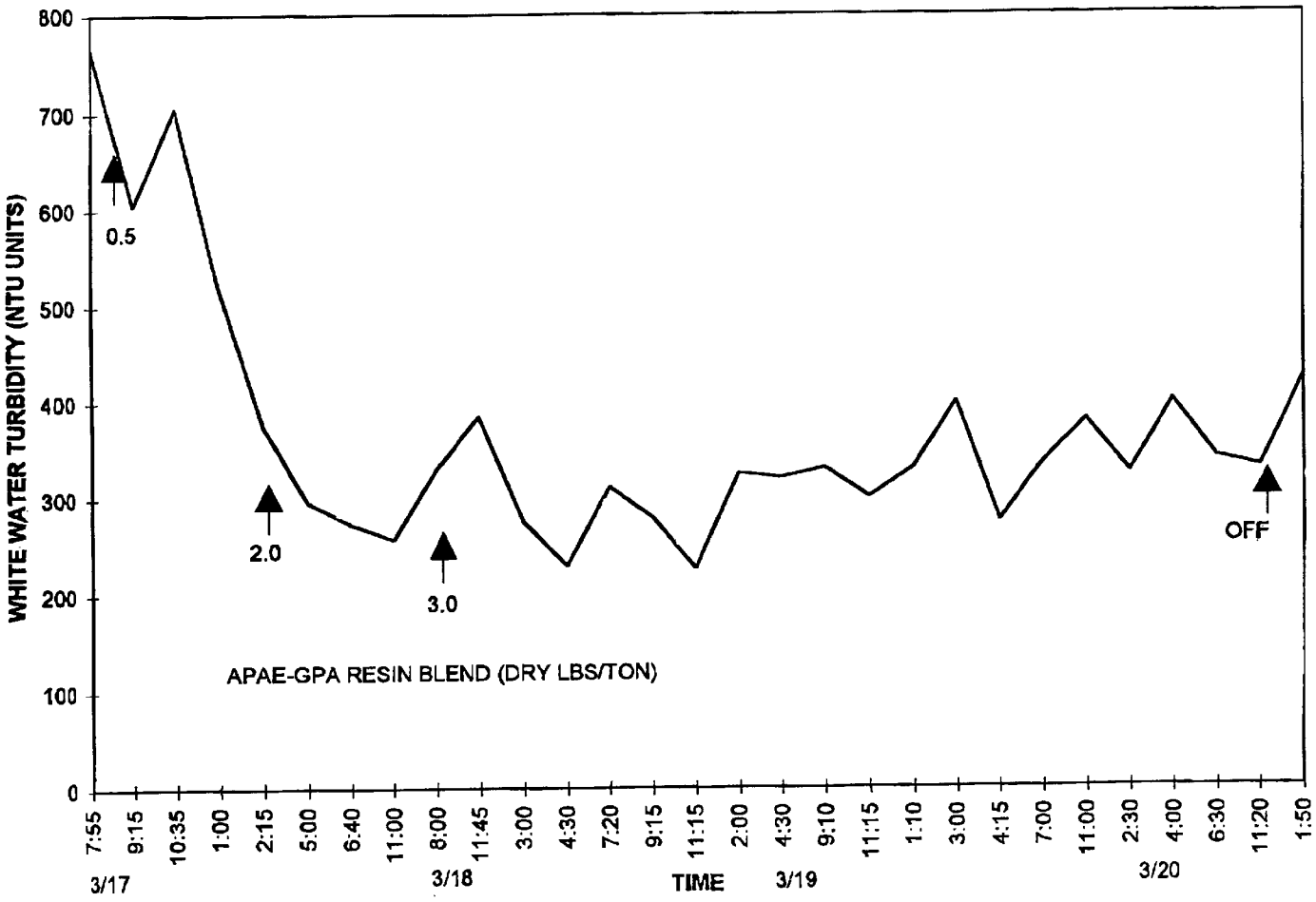
FIG. 2 is a graph showing the method of the invention increasing the dewatering performance of a paper machine.

Second, white water turbidity, primarily a measure of the amount of calcium carbonate that is not retained in the paper, was measured throughout the trial. As can be seen in FIG. 2, the white water turbidity was significantly decreased when the GPA:APAE resin blend was being added.

Figure 3:
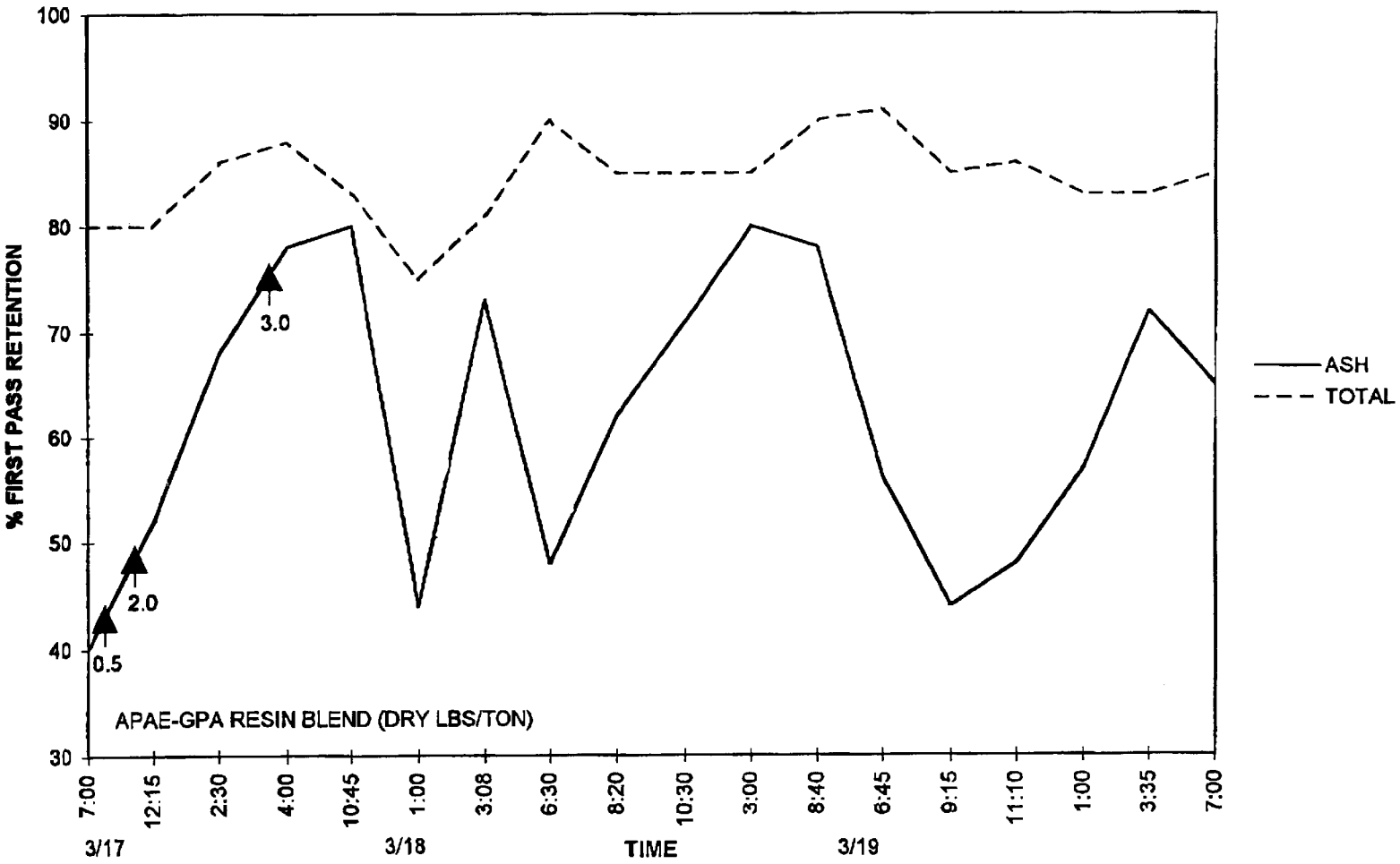
FIG. 3 is a graph showing the method of the invention increasing the retention of fillers during a papermaking process.

Also, first pass retention measures the amount of the fine particles (fine fibers and inorganic fillers) that are retained in the sheet as the pulp slurry drains on the forming wire. First pass ash retention is a measure of the amount of inorganic filler (calcium carbonate) that is retained in the sheet as the pulp slurry drains on the forming wire. As can be seen in FIG. 3, both total first pass retention and first pass ash retention were increased significantly when the GPA:APAE mixture of resins was being added to the furnish. Before the trial, total first pass retention was 81%. During the trial, total first pass retention increased to 86%. Before the trial, first pass ash retention was 40%. During the trial, first ash pass retention averaged 64%.

An electron microscopy study was carried out on paper produced both before and during the trial. Photomicrographs were taken of the top surface of the sheet at a magnification of 100×. Simultaneously, the surface of the sheet was irradiated with X-rays of a wave length that specifically activates calcium. The result is that any calcium-containing species (calcium carbonate in the case of the present study) will appear white in the photomicrograph. The results are shown in FIG. 4. It is evident that the distribution of the calcium carbonate over the fiber surfaces was much more uniform during the trial than before the trial when a conventional dual polymer retention system was being used.

A second experiment was run in which the top third of each sheet was ground off, and the ash content of the material removed was measured. The ash content is a direct measure of the calcium carbonate present in the sample. The ash content of the prior sample was 14.3% and that of the invention 15.7%. The ash values indicate that the calcium carbonate content in the top third of the sheet was somewhat higher during the trial than before the trial, but the difference in ash was much less dramatic than the difference in the uniformity of coverage of the fiber surfaces.

These studies show that the retention aid of the present invention retains fine particles as discrete small units that are uniformly adsorbed on fiber surfaces, while the conventional dual polymer retention system forms large flocs that are primarily retained by filtration during sheet formation.

Other sheet properties were essentially maintained during the trial. The trial results are shown in Table 1.

TABLE 1

| PROPERTY | TRIAL AVERAGE | 1997 AVERAGE |
|---|---|---|
| Basis Weight | 42.2 | 41.7 |
| Caliper | 17.9 | 18 |
| Size | 21.1 | 37.5 |
| MD Tear | 42.2 | 41.2 |
| CD Tear | 47.1 | 46.3 |

The only value that decreased during the trial was sizing; however, the average sizing number was still significantly higher than the minimum acceptable for the grade of paper (14).

What is claimed is:

1. A method for making alkaline fine paper which comprises adding (i) a glyoxylated acrylamide-diallyldimethyl ammonium chloride resin and (ii) an aminopolyamide-epichlorohydrin resin to an alkaline fine paper pulp slurry containing at least 5% filler during a papermaking process, said resins being added in an amount and at a rate sufficient to increase the retention of the filler in the paper and the drainage of process water from the slurry.

2. The method of claim 1, wherein the pulp slurry comprises bleached pulp and calcium carbonate filler.

3. The method of claim 1, wherein the glyoxylated acrylamide-diallyldimethyl chloride resin and the aminopolyamide-epichlorohydrin resin and are present at a weight ratio of about 1:3 to about 3:1.

4. The method of claim 1, wherein the glyoxylated acrylamide-diallyldimethyl chloride resin and the aminopolyamide-epichlorohydrin resin and are added at a rate that is from about 1 to about 10 lbs/ton.

5. The method of claim 1, wherein the glyoxylated acrylamide-diallyldimethyl ammonium chloride resin and the aminopolyamide-epichlorohydrin resin are used as a premixed resin solution.

6. The method of claim 5, wherein the premixed resin solution has a total solids that is from about 5 to about 20%.

7. The method of claim 1, wherein the glyoxylated acrylamide-diallyldimethyl ammonium chloride resin and the aminopolyamide-epichlorohydrin resin are added in an amount and a rate sufficient to increase the retention of fillers in the paper by at least 5%.

8. The method of claim 1, wherein the glyoxylated acrylamide-diallyldimethyl ammonium chloride resin and the aminopolyamide-epichlorohydrin resin are added in an amount and a rate sufficient to increase the drainage of process water from the slurry such that machine speed is increased by at least 5%.

9. The method of claim 1, wherein the mixed resin solution is added to the wet end of a paper machine.

10. In a method of making alkaline fine paper which comprises adding to an aqueous paper furnish a filler and a retention system, the improvement comprising adding (i) a glyoxylated acrylamide-diallyldimethyl ammonium chloride resin and (ii) an aminopolyamide-epichlorohydrin resin to the furnish in an amount and at a rate sufficient to increase the retention of filler in the paper and drainage of process water from the furnish.

11. The method of claim 10, wherein the pulp slurry comprises bleached pulp and calcium carbonate filler.

12. The method of claim 10, wherein the glyoxylated acrylamide-diallyldimethyl chloride resin and the aminopolyamide-epichlorohydrin resin and are present at a weight ratio of about 1:3 to about 3:1.

13. The method of claim 10, wherein the glyoxylated acrylamide-diallyldimethyl chloride resin and the aminopolyamide-epichlorohydrin resin and are added at a rate that is from about 1 to about 10 lbs/ton.

14. The method of claim 10, wherein the glyoxylated acrylamide-diallyldimethyl ammonium chloride resin and the aminopolyamide-epichlorohydrin resin are used as a premixed resin solution.

15. The method of claim 14, wherein the premixed resin solution has a total solids content that is from about 5 to about 20%.

16. The method of claim 14, wherein the mixed resin solution is added to the wet end of a paper machine.

* * * * *